US011509095B2

(12) United States Patent
Churnovic et al.

(10) Patent No.: US 11,509,095 B2
(45) Date of Patent: Nov. 22, 2022

(54) QUICK RELEASE PLUG PACK ASSEMBLY

(71) Applicant: Panduit Corp., Tinley Park, IL (US)

(72) Inventors: Roman J. Churnovic, Joliet, IL (US); Benjamin S. Novak, Lockport, IL (US); Adam Sargis, Frankfort, IL (US)

(73) Assignee: Panduit Corp., Tinley Park, IL (US)

( * ) Notice: Subject to any disclaimer, the term of this patent is extended or adjusted under 35 U.S.C. 154(b) by 28 days.

(21) Appl. No.: 17/197,643

(22) Filed: Mar. 10, 2021

(65) Prior Publication Data

US 2021/0305750 A1 Sep. 30, 2021

Related U.S. Application Data

(60) Provisional application No. 63/000,549, filed on Mar. 27, 2020.

(51) Int. Cl.

| | |
|---|---|
| ***H01R 13/635*** | (2006.01) |
| ***H01R 13/627*** | (2006.01) |
| ***H01R 13/436*** | (2006.01) |
| ***H01R 13/518*** | (2006.01) |

(52) U.S. Cl.

CPC ..... *H01R 13/635* (2013.01); *H01R 13/4361* (2013.01); *H01R 13/518* (2013.01); *H01R 13/6272* (2013.01)

(58) Field of Classification Search

CPC ..... H01R 13/635; H01R 13/62972; H01R 13/518; H01R 13/4361; H01R 13/6272

USPC ..... 439/540.1, 353, 352

See application file for complete search history.

(56) References Cited

U.S. PATENT DOCUMENTS

| | | | | |
|---|---|---|---|---|
| 4,575,168 | A | 3/1986 | Thomas | |
| 5,675,682 | A * | 10/1997 | De Marchi | H01R 13/6275 385/139 |
| 6,332,798 | B1 | 12/2001 | Farooq | |
| 6,547,585 | B2 | 4/2003 | Bradley et al. | |
| 6,672,898 | B2 * | 1/2004 | Kahle | G02B 6/3879 385/59 |
| 7,140,911 | B1 | 11/2006 | Rector et al. | |
| 7,354,291 | B2 * | 4/2008 | Caveney | H01R 13/6397 439/352 |
| 7,381,087 | B2 | 6/2008 | Alvarez | |

(Continued)

FOREIGN PATENT DOCUMENTS

| | | | | |
|---|---|---|---|---|
| FR | 3023422 | A1 * | 1/2016 | H01R 13/6335 |

*Primary Examiner* — Marcus E Harcum

(74) *Attorney, Agent, or Firm* — Christopher S. Clancy; James H. Williams; Peter S. Lee

(57) ABSTRACT

A cassette assembly includes a housing for plugs having release latches, the housing including a support surface and first hinge feature. The assembly also includes a compression lever including a post and a second hinge feature configured to cooperate with the first hinge feature to form a hinge. The assembly also includes a latch depressor including first and second ends, the latch depressor having a channel configured to receive the post. In response to a force applied to the compression lever with the first and second hinge features in cooperation, the channel in receipt of the post, and a plug in the housing, the compression lever rotates about the hinge, the post translates the force to the channel, the first end of the latch depressor abuts and pivots at the support surface, and the second end of the latch depressor contacts the release latch of the plug in the housing.

18 Claims, 8 Drawing Sheets

(56) References Cited

U.S. PATENT DOCUMENTS

| | | | | |
|---|---|---|---|---|
| 7,402,070 | B1 * | 7/2008 | Wu | H01R 13/6275 439/352 |
| 7,695,198 | B1 * | 4/2010 | Baechtle | G02B 6/3807 385/59 |
| 8,052,458 | B2 | 11/2011 | Rossman et al. | |
| 8,062,049 | B2 | 11/2011 | Tobey | |
| 8,152,385 | B2 * | 4/2012 | de Jong | G02B 6/3888 385/71 |
| 8,167,638 | B2 | 5/2012 | Wojcik et al. | |
| 8,287,191 | B2 * | 10/2012 | Nielson | G02B 6/3879 439/304 |
| 8,764,308 | B2 * | 7/2014 | Irwin | G02B 6/3825 385/75 |
| 9,069,149 | B2 | 6/2015 | Yu | |
| 9,293,862 | B2 * | 3/2016 | Fransen | H04Q 1/06 |
| 9,698,529 | B1 | 7/2017 | Schow et al. | |
| 10,811,808 | B2 * | 10/2020 | Kleeberger | H01R 24/64 |
| 10,873,157 | B1 * | 12/2020 | Costello | H01R 13/6335 |
| 10,935,736 | B2 * | 3/2021 | Bragg | G02B 6/3893 |
| 2012/0040545 | A1 * | 2/2012 | Wang | H01R 13/635 439/157 |
| 2013/0051733 | A1 * | 2/2013 | Gallegos | G02B 6/3879 385/76 |
| 2014/0161397 | A1 * | 6/2014 | Gallegos | G02B 6/3879 385/89 |
| 2021/0302665 | A1 * | 9/2021 | Gandla | G02B 6/3879 |

* cited by examiner

QUICK RELEASE PLUG PACK ASSEMBLY

CROSS-REFERENCE TO RELATED APPLICATION(S)

This application claims benefit to U.S. Provisional Patent App. No. 63/000,549, filed on Mar. 27, 2020, the entirety of which is hereby incorporated by reference herein.

TECHNICAL FIELD

The following relates to a plug pack cassette assembly for housing and enabling quick insertion and release of a plurality of plugs together.

BACKGROUND

Plug pack assemblies are provided to hold a plurality of plugs simultaneously in a ganged configuration. Quick release plug pack assemblies are designed to allow for simultaneous quick insertion and removal of a plurality of plugs housed in the assemblies to or from switch port jacks.

Different sizes and shapes to the plug cassette assemblies may be applied to fit into different switch port applications.

SUMMARY

According to one non-limiting exemplary embodiment described herein, a cassette assembly is provided. The cassette assembly comprises a housing configured to house at least two plugs, wherein each of the plugs comprise a release latch, the housing comprising a slot at a front end, and a flat surface located within an outer perimeter of the housing. The cassette assembly further comprises a compression lever comprising a compression pad positioned at a back end opposite the front end, a boss member positioned at the front end, the boss member configured to fit within the slot, wherein the compression lever is configured to rotate about the boss member when the boss member is fit within the slot and a force is applied to the compression pad, and a post. The cassette assembly further comprises a latch depressor comprising a channel configured to receive the post, a back edge positioned at the back end, wherein the latch depressor is configured to pivot about the back edge when the force is applied to the latch depressor through the post and the back edge is abutted against the flat surface of the housing, and a front edge positioned at the front end, wherein a path of rotation of the latch depressor includes the front edge contacting the release latch of the at least two plugs housed in the housing.

According to another non-limiting exemplary embodiment described herein, a cassette assembly is provided comprising a housing configured to house a plurality of plugs each having a release latch, the housing comprising a support surface and a first hinge feature. The cassette assembly further comprises a compression lever comprising a second hinge feature and a post, the second hinge feature configured to cooperate with the first hinge feature of the housing to form a hinge. The cassette assembly further comprises a latch depressor comprising a first end and a second end, the latch depressor having a channel formed therein configured to receive the post of the compression lever. In response to a force applied to the compression lever with the first hinge feature in cooperation with the second hinge feature, the channel in receipt of the post, and at least one plug housed in the housing, the compression lever rotates about the hinge, the post of the compression lever translates the force to the channel of the latch depressor, the first end of the latch depressor abuts and pivots at the support surface, and the second end of the latch depressor contacts the release latch of the at least one plug in the housing.

According to yet another non-limiting exemplary embodiment described herein, a cassette assembly is provided comprising a housing configured to house a plurality of plugs each having a release latch, the housing comprising a support surface and a first hinge feature. The cassette assembly further comprises a latch depressor comprising a first end, a second end, and a post. The cassette assembly further comprises a compression lever comprising a second hinge feature configured to cooperate with the first hinge feature of the housing to form a hinge, the compression lever having a channel formed therein configured to receive the post of the latch depressor. In response to a force applied to the compression lever with the first hinge feature in cooperation with the second hinge feature, the channel in receipt of the post, and at least one plug housed in the housing, the compression lever rotates about the hinge, the channel of the compression lever translates the force to the post of the latch depressor, the first end of the latch depressor abuts and pivots at the support surface, and the second end of the latch depressor contacts the release latch of the at least one plug in the housing.

A detailed description of these and other non-limiting exemplary embodiments of an improved plug pack assembly for housing a plurality of plugs is set forth below together with the accompanying drawings.

DETAILED DESCRIPTION

Figure 1:
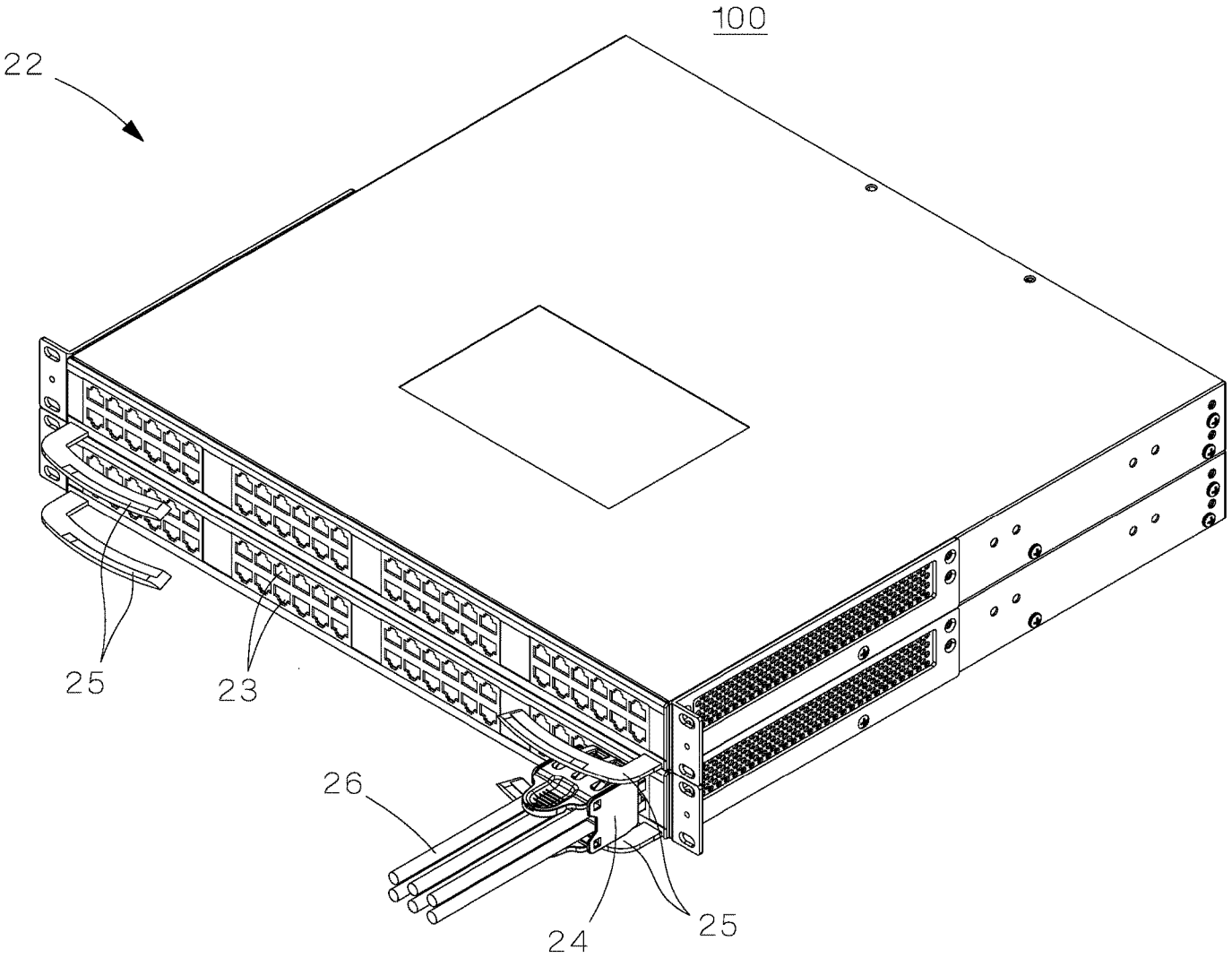
FIG. 1 is a front isometric view of communications system for use with a non-limiting exemplary embodiment of a cassette assembly according to the present disclosure.

As required, detailed non-limiting embodiments are disclosed herein. However, it is to be understood that the disclosed embodiments are exemplary and may take various and alternative forms while still being within the scope of the features described in this disclosure. The figures are not necessarily to scale, and features may be exaggerated or minimized to show details of particular components. Therefore, specific structural and functional details disclosed herein are not limiting, but may provide a representative basis for teaching one skilled in the art.

A known quick release plug cassette assembly is shown and described in U.S. Pat. No. 8,167,638 entitled "Multi-Position Quick Release Plug Cassette Assembly," which is hereby incorporated by reference herein in its entirety. The quick release plug cassette assembly thereof may be referred to as "plug pack," and is provided for use with high density switches and routers. One version of the quick release plug cassette assembly shown and described therein allows a user to disengage six plugs from a switch or router with one hand, thereby speeding up the process of moves, adds, or changes to infrastructure. Other port density plug packs are also available.

The current plug pack as described herein is designed for use between two layers of switch ports. To better adapt to certain switch port assemblies on which the current plug pack will be installed, the plug pack incorporates a pivot point design that allows for a lower profile (i.e., lower height) compared to the plug pack design in the U.S. Pat. No. 8,167,638. Having the lower profile reduces the overall height of the plug pack, which in turn allows the plug pack to be installed onto certain switch assemblies without interfering with other components found on the switch port assemblies such as, for example, ejection levers that are positioned in the path of installation of the plug pack. Therefore, the current plug pack addresses the need for an improved cable management solution which facilitates fast and easy installations, including mass insertion and mass removal of plugs, while also offering a low-profile design to avoid interference with existing components of the switch port assembly.

With reference to FIGS. 1-8, a more detailed description of non-limiting exemplary embodiments of an improved plug pack for housing and quickly releasing a plurality of plugs will be provided. For ease of illustration and to facilitate understanding, like reference numerals have been used herein for like components and features throughout the drawings.

FIG. 1 is a front isometric view of communications system 100 which includes a switch chassis 22, a plug pack housing assembly 24, and patch cords 26. The switch chassis 22 includes a plurality of jack ports 23 and ejector levers 25. As shown in FIG. 1, the height profile of the plug pack housing assembly 24 is reduced to not interfere with a pathway of the ejector levers 25 during an operational movement of the ejector levers.

Figure 2:
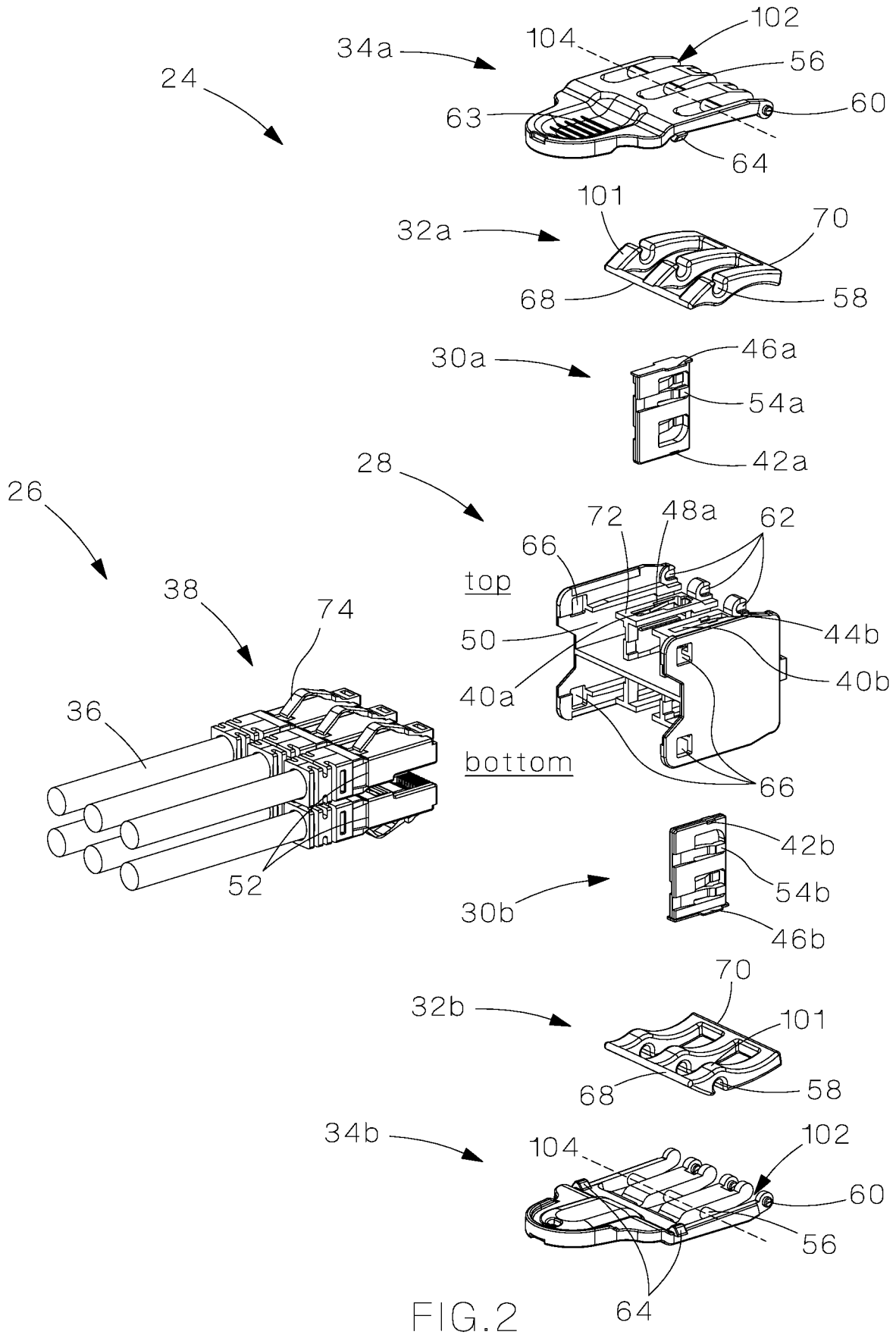
FIG. 2 is an isometric, exploded view of a non-limiting exemplary embodiment of a cassette assembly according to the present disclosure.
Figure 3:
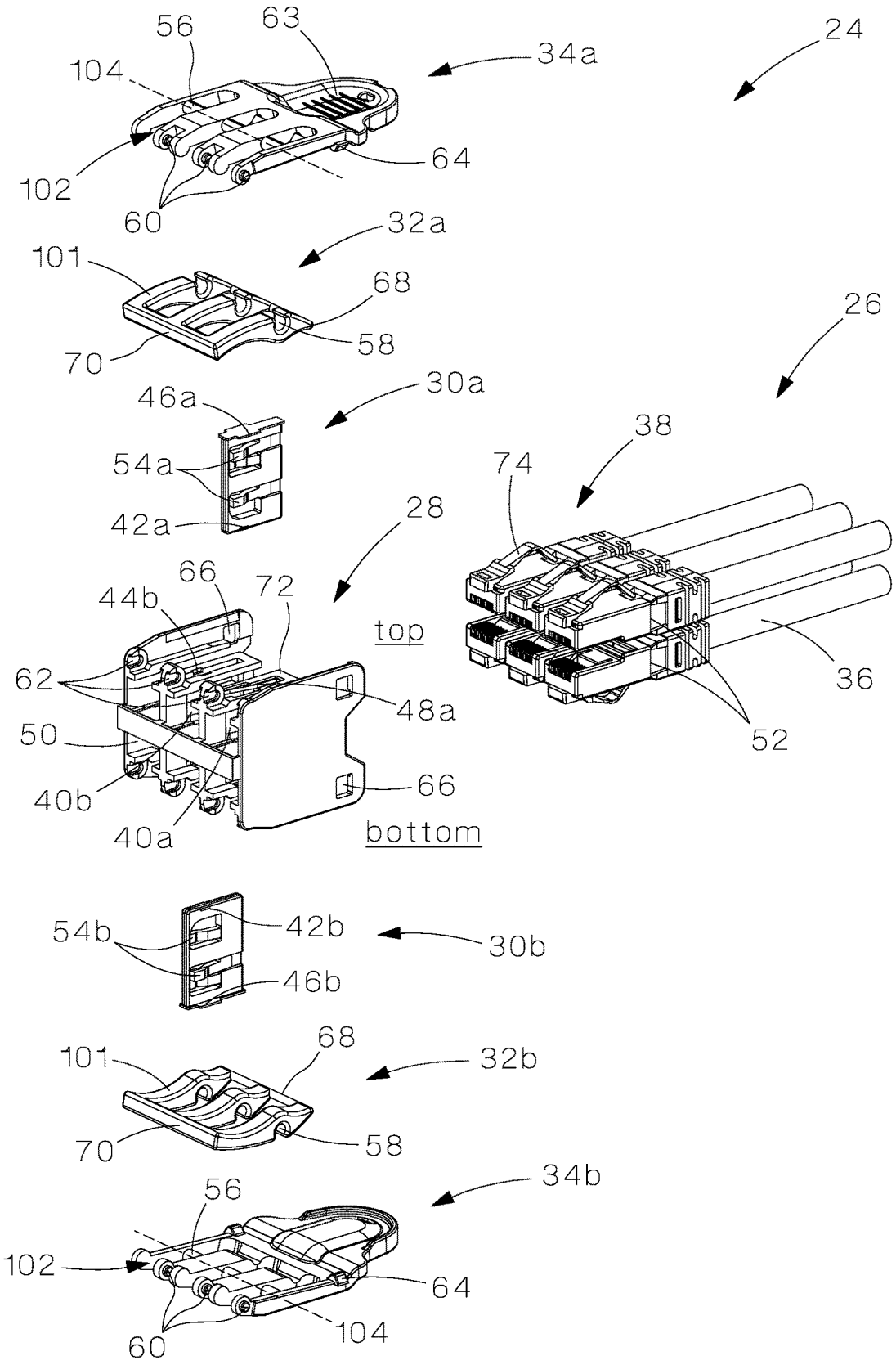
FIG. 3 is an isometric exploded view of a non-limiting exemplary embodiment of a cassette assembly according to the present disclosure.

FIG. 2 is an isometric exploded view of a plug pack housing assembly 24 with patch cords 26. FIG. 3 is an isometric exploded view of the plug pack housing assembly 24 with patch cords 26 of FIG. 2, rotated 180° about a vertical axis. The plug pack housing assembly 24 includes a plug organizer 28, housing clip inserts 30*a*, 30*b*, latch depressors 32 *a*, 30*b*, and compression levers 34*a*, 34*b*. The 'a' and 'b' connotations are intended to reference mirroring components of the plug pack housing assembly 24 at a top and bottom side, respectively, of the plug organizer 28. The mirroring components work together to enable a "pinching" function initiated by applying a force on the two compression levers 34*a*, 34*b*, where the pinching function is the application of a force pushing the two compression levers 34*a*, 34*b* towards each other.

The patch cords 26 include cables 36 and plugs 38. Although the plug pack housing assembly 24 is shown to hold six total plugs in a 2×3 (height×width) arrangement, other total number of plugs and arrangements are within the scope of the plug pack housing assembly 24 of this disclosure.

To achieve an assembled state, the housing clip inserts 30*a*, 30*b* pass through their respective cavities 40*a*, 40*b* formed in the plug organizer 28 through a top and bottom face of the plug organizer 28. For example, edge latches 42*a*, 42*b* formed on the housing clip inserts 30*a*, 30*b* are configured to fit through their respective openings to the cavities 40*a*, 40*b* on the top and bottom face of the plug organizer 28, respectively.

For example, the top-side housing clip insert 30*a* is inserted down through the top opening of its respective cavity 40*a*, starting with the bottom end including the edge latch 42*a*, until the edge latch 42*a* secures to a corresponding edge (not shown) at the bottom face of the plug organizer 28. When the edge latch 42*a* is secured to the corresponding edge at the bottom face of the plug organizer 28, a flat face 46*a* at the top end of the housing clip insert 30*a* is secured to a ledge 48*a* of the plug organizer 28 that defines the top opening to the cavity 40*a*. The ledge 48*a* is formed to prevent the housing clip insert 30*a* from traveling completely through its cavity 40*a*.

Similarly, the bottom-side housing clip insert 30*b* is inserted up through the bottom opening of its respective cavity 40*b*, starting with the top end including the edge latch 42*b*, until the edge latch 42*b* secures to a corresponding edge 44*b* at the top face of the plug organizer 28. When the edge latch 42*b* is secured to the corresponding edge 44*b* at the top face of the plug organizer 28, a flat face 46*b* at the bottom card of the housing clip insert 30*b* is secured to a ledge (not shown) of the plug organizer 28 that defines the bottom opening to the cavity 40*b*. The ledge at the bottom face of the plug organizer 28 is formed to prevent the housing clip insert 30*b* from traveling completely through its cavity 40*b*. With the edge latches 42*a*, 42*b* and the flat faces 46*a*, 46*b* secured to the plug organizer 28, the housing clip inserts 30*a*, 30*b* are in their assembled state to the plug organizer 28.

With the housing clip inserts 30*a*, 30*b* fully assembled to the plug organizer 28, the plugs 38 may be inserted into slots 50 formed in the plug organizer 28, where the housing clip inserts 30*a*, 30*b* provide a securing mechanism for securing the plugs 38 within the plug organizer 28. Specifically, as the plugs 38 are inserted into their respective slots 50, stop edges 52 provided on the plugs 38 will reach a position to abut against clip insert the latches 54*a*, 54*b* of the housing clip inserts 30*a*, 30*b* that are installed into the plug organizer 28. With this contact relationship, the plugs 38 are secured in place within their respective slots 50.

Removal of the housing clip inserts 30*a*, 30*b* may be achieved with a separate removal tool (not illustrated). The removal tool includes one or more removal edges that are inserted into the plug organizer 28 to contact the latches 54*a*, 54*b* of the clip inserts 30*a*, 30*b* and compresses them to release their abutment to the release latch 74 of the plugs 38. In operation, a release lever on the removal tool may be pushed forward to initiate the removal edges to compress against the latches 54*a*, 54*b* and allow for the plugs 38 to be removed from the plug organizer 28.

With the patch cords 26 secured into the fully assembled plug pack housing assembly 24, all six plugs 38 can now be simultaneously engaged with their corresponding jack ports 23 of the switch chassis 22. In that regard, while six plugs 38 are shown herein, the design of the plug pack housing assembly 24 described herein could be modified to operate with different numbers of plugs 38.

The compression levers 34*a*, 34*b* are provided with one or more posts 56, where the posts 56 are press fit into one or more channels 58 formed in the latch depressors 32*a*, 32*b*. Hinge features, such as one or more round bosses 60, may be provided on the compression levers 34*a*, 34*b* for fitting into cooperating hinge features, such as slots 62, formed in the plug organizer 28.

In describing an operation of the plug pack housing assembly 24, a force may be applied to the compression levers 34*a*, 34*b* by pressing on the respective thumb pads 63, thus causing the thumb pads 63 to move inwards towards each other. Such a force applied to the thumb pads 63 causes the compression levers 34*a*, 34*b* to rotate about the round bosses 60 that are secure fitted into their respective slots 62 on the plug organizer (i.e., the hinge mechanism formed thereby). The resulting movement also correlates to the latches 64 on the compression levers 34*a*, 34*b* to pass through windows 66 formed in the side walls of the plug organizer 28. It follows that the movement of the latches 64 as they travel within the windows 66 defines a range of motion for the compression levers 34*a*, 34*b* while also preventing removal of the compression levers 34*a*, 34*b* and the latch depressors 32*a*, 32*b* from the plug pack housing assembly 24.

Moreover to describe an exemplary removal operation, when the compression levers 34*a*, 34*b* are depressed, all six plugs 38 may be simultaneously removed from their corresponding jack ports 23 in the switch chassis 22. So by applying the same type of compression force to the compression levers 34*a*, 34*b* by pressing on the respective thumb pads 63, this causes the compression levers 34*a*, 34*b* to rotate about the round bosses 60 that are secured into their respective slots 62 (i.e., the hinge formed thereby). This rotational movement further causes the posts 56 on the compression levers 34*a*, 34*b* to translate the applied force to the latch depressors 32*a*, 32*b* by pressing down onto the channels 58 of the latch depressors 32*a*, 32*b*, When this happens, the end or edge 68 (which may be cylindrical) on the latch depressors 32*a*, 32*b* is moved into contact with a support surface 72 (which may be flat) provided on the plug organizer 28.

When the edge 68 abuts against the support surface 72, this causes the edge 68 to act as a pivot point as the posts 56 continue to push into their respective channels 58 and act as a rotation point for the latch depressors 32*a*, 32*b*. That is, the latch depressors 32*a*, 32*b* are actuated to rotationally move towards the release latches 74 of the plugs 38 that are installed into the plug pack housing assembly 24. As a result, an end or edge 70 which may be provided on the latch depressors 32*a*, 32*b* are rotated forward to contact and compress the release latches 74 of the plugs 38 installed into the plug pack housing assembly 24. Then by compressing the release latches 74, this causes the plugs 38 to disengage from their corresponding jack ports 23. In such a fashion, the plug pack housing assembly 24 provides for the simultaneous removal of the patch cords 26 from corresponding jack ports 23 of the switch chassis 27.

Figure 4:
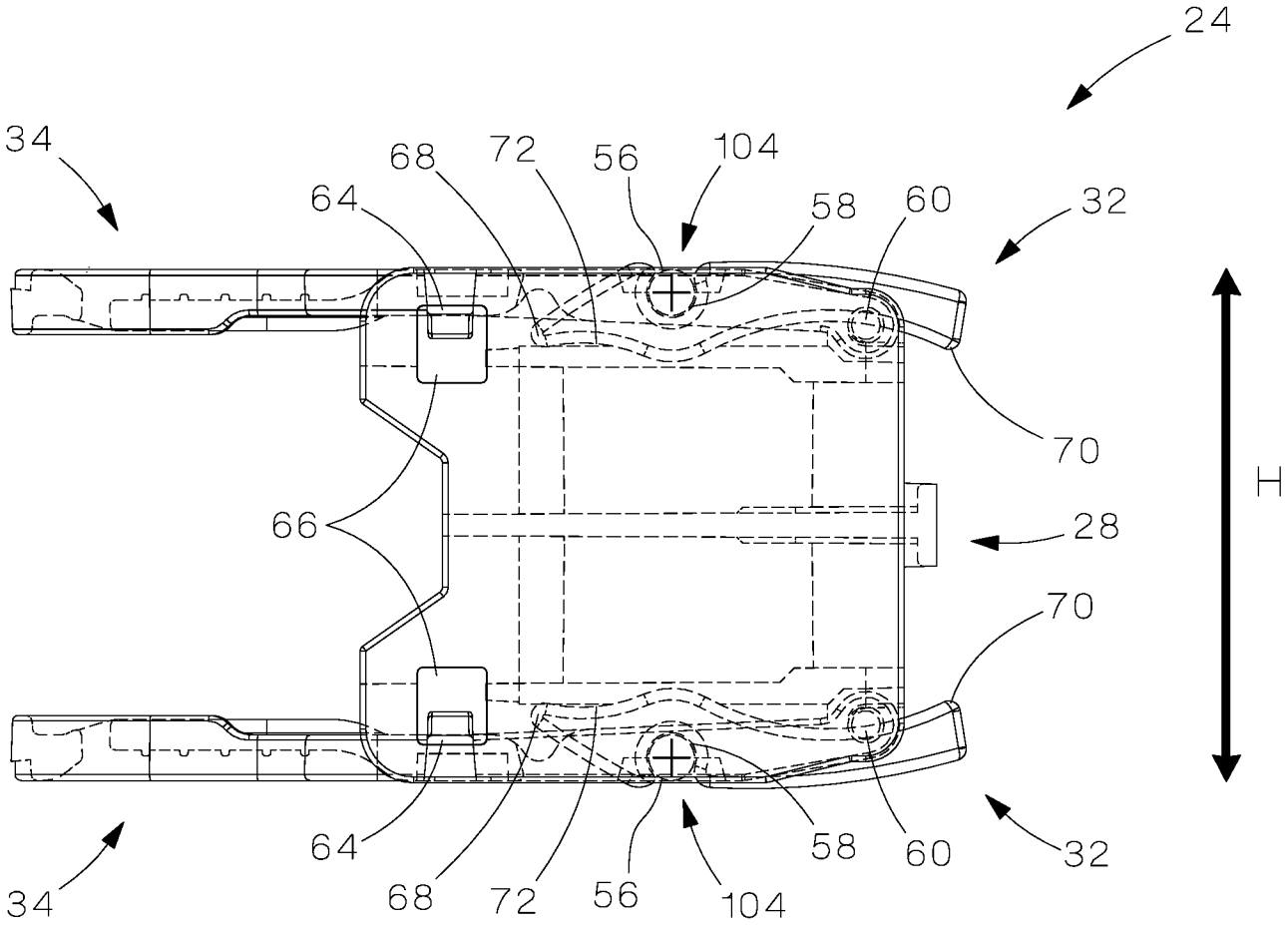
FIG. 4 is a hidden line side view of a non-limiting exemplary embodiment of a cassette assembly according to the present disclosure in an open position.
Figure 5:
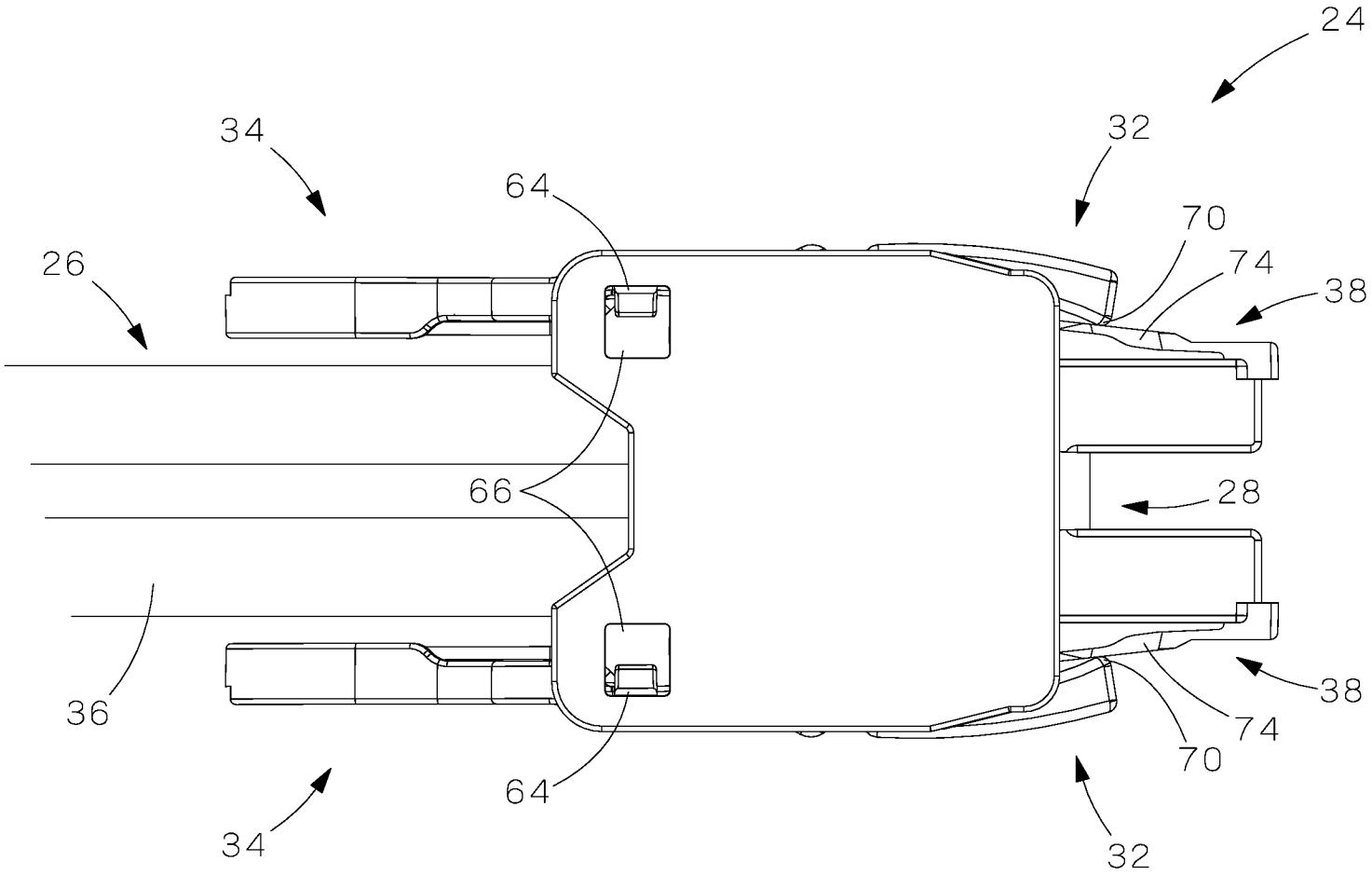
FIG. 5 is a side view of a non-limiting exemplary embodiment of a cassette assembly according to the present disclosure in an open position with patch cords installed.

FIG. 4 is a hidden line side view of the plug pack housing assembly 24 in the open position where the compression levers 34*a*, 34*b* are in a resting state as the force has not been applied to the compression levers 34*a*, 34*b*. The hidden lines refer to the dashed lines, where the hidden lines provide a detailed view into certain internal components of the plug organizer 28 that are otherwise not visible due to the side walls of the plug organizer 28 (e.g., the side walls are the walls including the pass through windows 66). FIG. 4 also illustrates the plug pack housing assembly 24 without having the plugs 38 of the patch cords 26 installed. FIG. 5 is a side view of the plug pack housing assembly 24 in the open position where the patch cords 26 are illustrated to be installed within the plug pack housing assembly 24.

Figure 6:
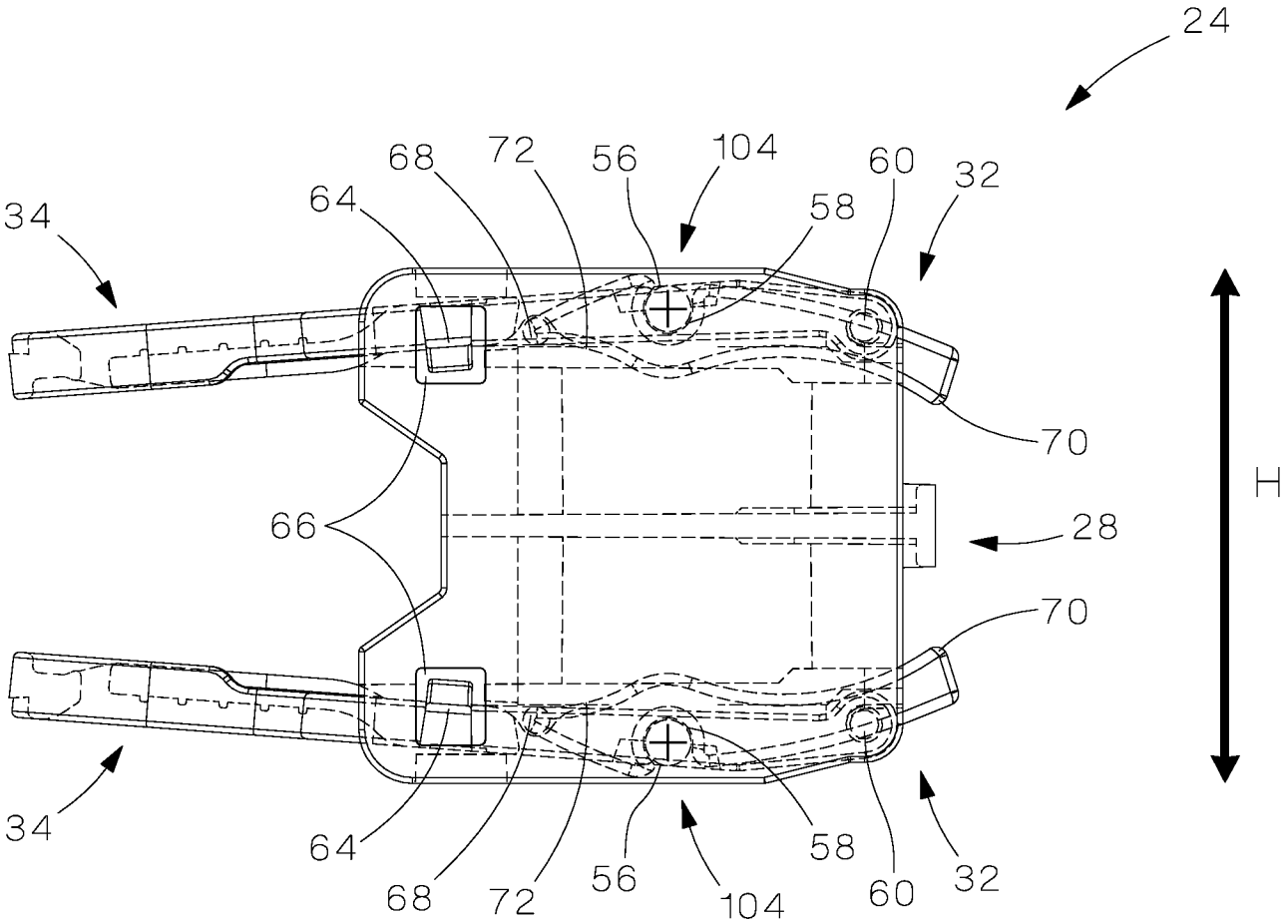
FIG. 6 is a hidden line side view of a non-limiting exemplary embodiment of a cassette assembly according to the present disclosure in a closed position.
Figure 7:
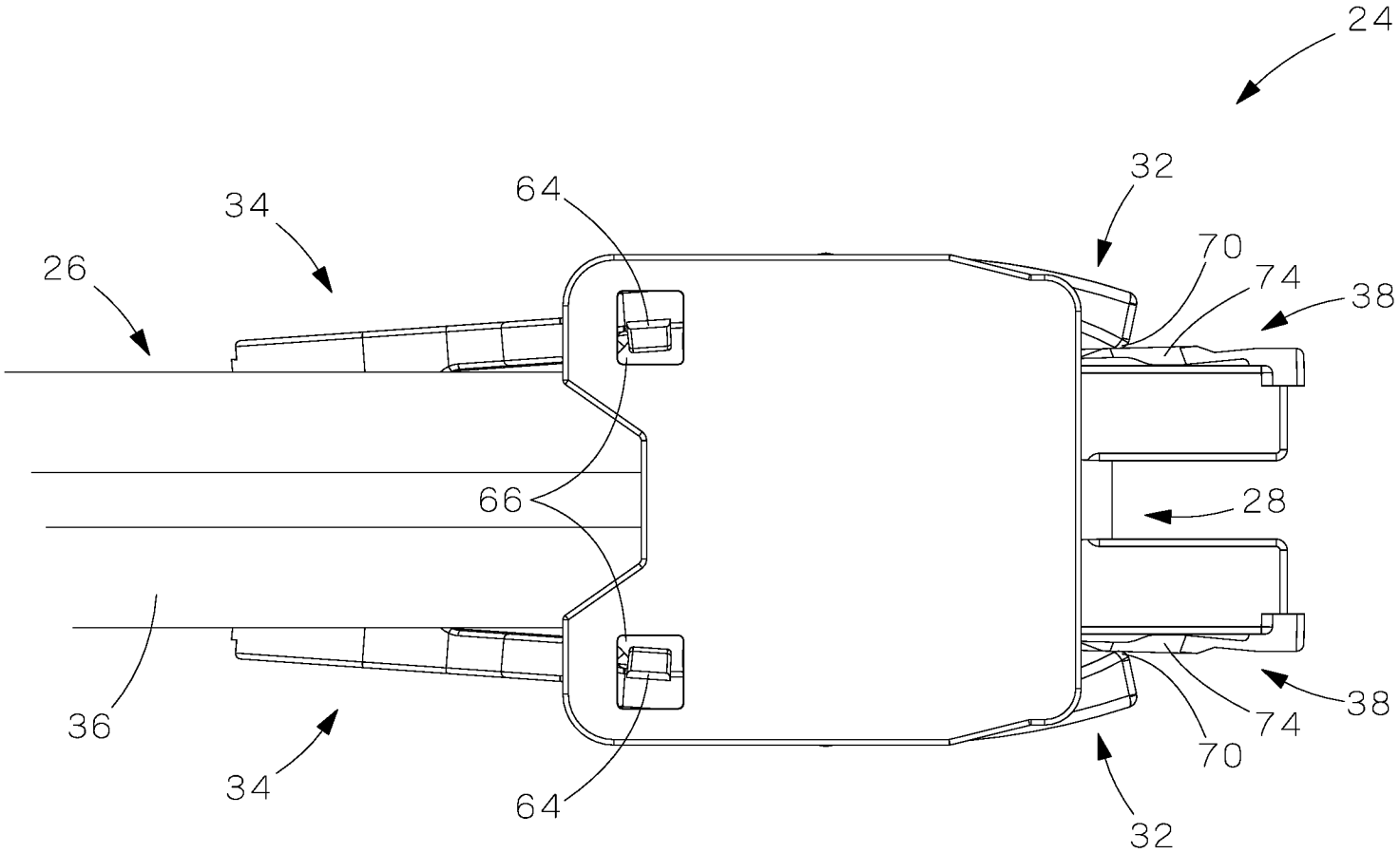
FIG. 7 is a side view of a non-limiting exemplary embodiment of a cassette assembly according to the present disclosure in a closed position with patch cords installed.

FIG. 6 is a hidden line side view of the plug pack housing assembly 24 in the closed position where the compression levers 34*a*, 34*b* are in an engaged stated where they are compressed together caused by the force being applied to the compression levers 34*a*, 34*b*. FIG. 6 also illustrates the plug pack housing assembly 24 without having the plugs 38 of the patch cords 26 installed. FIG. 7 is a side view of the plug pack housing assembly 24 in the closed position where the patch cords 26 are illustrated to be installed within the plug pack housing assembly 24.

As seen in FIGS. 2-6, the channels 58 formed in the latch depressors 32*a*, 32*b* may run through an outer surface 101 of the latch depressors 32*a*, 32*b*. As also seen therein, the compression levers 34*a*, 34*b* may have one or more openings 102 formed therein, and the posts 56 of the compression levers 34*a*, 34*b* may be located at least partially within such openings 102. In that regard, the openings 102 formed in the compression levers 34*a*, 34*b* are configured to receive at least a portion of their associated latch depressors 32*a*, 32*b*. That is, with the channels 58 (formed at least partially beneath the outer surface 101 of the latch depressors 32) in receipt of the posts 56 of the associated compression levers 34*a*, 34*b*, the compression levers 34*a*, 34*b* and the latch depressors 32*a*, 32*b* are interleaved and coaxial about a longitudinal axis 104 of the posts 56.

In such a fashion, the interleaved latch depressors 32*a*, 32*b* and compression levers 34*a*, 34*b* of the present plug pack housing assembly 24 occupy a substantially overlapping space to achieve a lower profile (height) compared to, for example, a stacked, side-by-side, arrangement where a pivot point of a compression lever is tied to the sidewalls of a plug organizer as shown in U.S. Pat. No. 8,167,638 (see FIGS. 5 and 6 thereof). As a result, the profile or height (H) of the plug pack housing assembly 24 of the present disclosure may be reduced or lowered, thereby allowing the cassette assembly to be installed and operate in the switch chassis 22 while avoiding interference with components such as the ejector levers 25.

Figure 8:
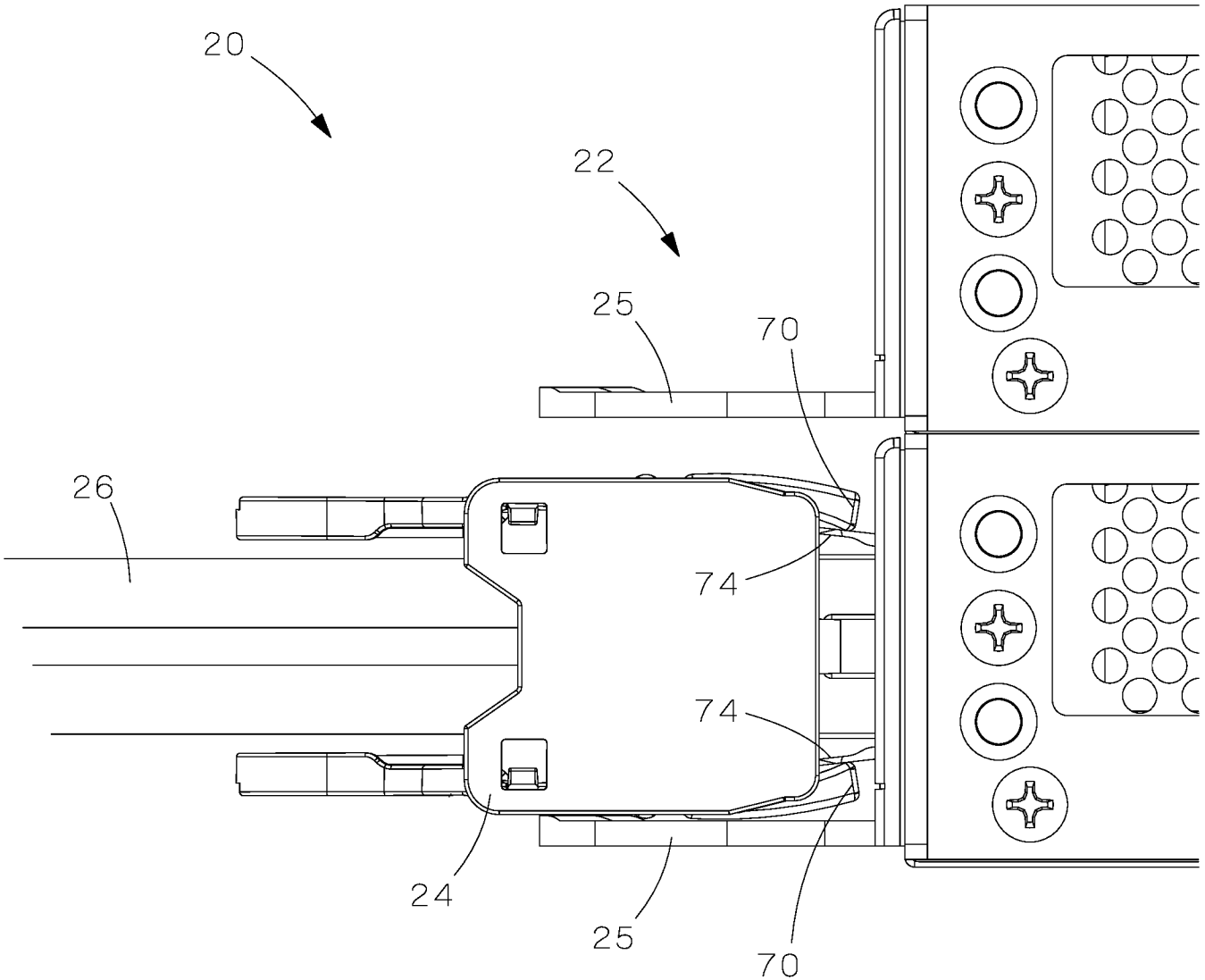
FIG. 8 is a side view of communications system for use with a non-limiting exemplary embodiment of a cassette assembly according to the present disclosure.

In that regard, FIG. 8 is a side view of a communications system 20 and a plug pack housing assembly 24 according to one embodiment of the present disclosure. By virtue of its design as shown and described herein, the plug pack housing assembly 24 of the present disclosure is provided with a reduced height (H) to thereby avoid contact with the ejector levers 25 of the switch chassis 22.

As shown and described herein, the latch depressors 32*a*, 32*b* may have one or more channels 58 formed therein and the compression levers 34 may comprise one or more posts 56 and have one or more openings 102 formed therein. Those of ordinary skill will understand that this configuration may alternatively be reversed. That is, alternatively, the latch depressors 32 may comprise one or more posts 56 and have one or more openings 102 formed therein and the compression levers 34 may have one or more channels 58 formed therein. Such an alternative configuration would provide the same benefits as those associated with the plug pack housing assembly 24 of the present disclosure as shown and described herein.

The present disclosure thus describes an improved cassette assembly for housing and quick release of a plurality of plugs. The improved cable management solution of the present disclosure facilitates fast and easy installations, including mass insertion and mass removal of plugs. The present disclosure also provides a quick release plug cassette assembly that can be used on switches with ejector levers.

As is readily apparent from the foregoing, various non-limiting embodiments of an improved cassette assembly for housing and quick release of a plurality of plugs have been described. While various embodiments have been illustrated and described herein, they are exemplary only and it is not intended that these embodiments illustrate and describe all those possible. Instead, the words used herein are words of description rather than limitation, and it is understood that various changes may be made to these embodiments without departing from the spirit and scope of the following claims.

What is claimed is:

1. A cassette assembly comprising:

a housing configured to house at least two plugs, wherein each of the plugs comprise a release latch, the housing comprising:

a slot at a front end; and a flat surface located within an outer perimeter of the housing;

a compression lever comprising:

a compression pad positioned at a back end opposite the front end;

a boss member positioned at the front end, the boss member configured to fit within the slot, wherein the compression lever is configured to rotate about the boss member when the boss member is fit within the slot and a force is applied to the compression pad; and a post; and a latch depressor comprising:

a channel configured to receive the post;

a back edge positioned at the back end, wherein the latch depressor is configured to pivot about the back edge when the force is applied to the latch depressor through the post and the back edge is abutted against the flat surface of the housing; and a front edge positioned at the front end, wherein a path of rotation of the latch depressor includes the front edge contacting the release latch of the at least two plugs housed in the housing.

2. The cassette assembly of claim 1, wherein the application of the force on the compression pad is translated through the latch depressor and to the release latch of the at least two plugs to move the release latch of the at least two plugs from a latched position to an unlatched position.

3. The cassette assembly of claim 1, wherein the housing further comprises a first sidewall including a first window and a second sidewall including a second window, and wherein the compression lever further comprises a first window latch configured to fit within the first window, and a second window latch configured to fit within the second window.

4. The cassette assembly of claim 3, wherein a travel of the first window latch and the second window latch within the first window and second window, respectively, control a range of rotational movement of the compression lever.

5. The cassette assembly of claim 1, further comprising a housing clip insert configured to be secured to the housing through a top opening, wherein the housing clip insert is configured to secure the at least two plugs into the housing within respective plug channels.

6. The cassette assembly of claim 1, further comprising a housing clip comprising:

a first projection extending in a first direction and positioned in a path of removal of a first plug inserted in a first plug channel of the housing; and a second projection extending in a second direction and positioned in a path of removal of a second plug inserted in a second plug channel of the housing.

7. The cassette assembly of claim 1, wherein the at least two plugs are configured to be inserted into respective plug channels formed in the housing through the back end.

8. The cassette assembly of claim 7, wherein at least a portion of the two plugs are configured to extend out of the front end of the housing in an inserted state.

9. A cassette assembly comprising:

a housing configured to house a plurality of plugs each having a release latch, the housing comprising a support surface and a first hinge feature;

a compression lever comprising a second hinge feature and a post, the second hinge feature configured to cooperate with the first hinge feature of the housing to form a hinge;

a latch depressor comprising a first end and a second end, the latch depressor having a channel formed therein configured to receive the post of the compression lever; and wherein, in response to a force applied to the compression lever with the first hinge feature in cooperation with the second hinge feature, the channel in receipt of the post, and at least one plug housed in the housing, the compression lever rotates about the hinge, the post of the compression lever translates the force to the channel of the latch depressor, the first end of the latch depressor abuts and pivots at the support surface, and the second end of the latch depressor contacts the release latch of the at least one plug in the housing;

wherein the channel formed in the latch depressor is formed at least partially beneath an outer surface of the latch depressor; and wherein the compression lever includes an opening formed therein, the post is located at least partially within the opening, and the opening is configured to receive at least a portion of the latch depressor.

10. The cassette assembly of claim 9 wherein the first hinge feature of the housing comprises a slot formed therein and the second hinge feature of the compression lever comprises a boss member.

11. The cassette assembly of claim 9, wherein, with the channel in receipt of the post, the compression lever and the latch depressor are interleaved and coaxial about a longitudinal axis of the post.

12. The cassette assembly of claim 9 wherein the latch depressor rotates relative to the compression lever about the post.

13. The cassette assembly of claim 9, the housing further comprising:

a plurality of slots, each of the plurality of slots configured to receive a respective plug included in the plurality of plugs.

14. The cassette assembly of claim 9, the housing further comprising:

a plurality of slots arranged in at least two rows, each of the plurality of slots configured to receive a respective plug included in the plurality of plugs.

15. The cassette assembly of claim 9, wherein the plurality of plugs includes at least six plugs.

16. The cassette assembly of claim 9, further comprising a housing clip insert configured to be secured to the housing, wherein the housing clip insert is configured to secure the plurality of plugs into respective plug channels included in the housing.

17. The cassette assembly of claim 9, wherein the plurality of plugs are configured to be inserted into respective plug channels included in the housing through a back end of the housing.

18. The cassette assembly of claim 9, wherein when the plurality of plugs are installed within the housing, at least a portion of each of the plurality of plugs are configured to extend out a front end of the housing.

* * * * *